US007784275B2

(12) United States Patent
Marlett et al.

(10) Patent No.: US 7,784,275 B2
(45) Date of Patent: Aug. 31, 2010

(54) OPTIMIZATION OF HYDROCARBON INJECTION DURING DIESEL PARTICULATE FILTER (DPF) REGENERATION

(75) Inventors: Chad E. Marlett, Plymouth, MI (US); Rahul Mital, Rochester Hills, MI (US)

(73) Assignee: GM Global Technology Operations, Inc.

( * ) Notice: Subject to any disclaimer, the term of this patent is extended or adjusted under 35 U.S.C. 154(b) by 1377 days.

(21) Appl. No.: 11/233,978

(22) Filed: Sep. 23, 2005

(65) Prior Publication Data

US 2006/0201142 A1 Sep. 14, 2006

Related U.S. Application Data

(60) Provisional application No. 60/661,536, filed on Mar. 14, 2005.

(51) Int. Cl.
*F01N 3/00* (2006.01)

(52) U.S. Cl. ..... 60/295; 60/274; 60/276; 60/297; 60/311

(58) Field of Classification Search ..... 60/274, 60/276, 295, 297, 311
See application file for complete search history.

(56) References Cited

U.S. PATENT DOCUMENTS

| | | | | |
|---|---|---|---|---|
| 6,199,375 | B1 * | 3/2001 | Russell | 60/286 |
| 6,202,406 | B1 * | 3/2001 | Griffin et al. | 60/274 |
| 6,739,176 | B2 * | 5/2004 | Neuhausen et al. | 73/23.31 |
| 6,829,890 | B2 * | 12/2004 | Gui et al. | 60/295 |

* cited by examiner

*Primary Examiner*—Thomas E Denion
*Assistant Examiner*—Diem Tran

(57) ABSTRACT

A diesel engine system having an exhaust system with a catalyst and a diesel particulate filter includes a first module that determines a light-off temperature of the catalyst based on an exhaust flow rate (EFR) through the exhaust system and a second module that selectively generates an enable signal based on the light-off temperature and a catalyst temperature. A DPF regeneration sequence is enabled based on said enable signal.

16 Claims, 3 Drawing Sheets

OPTIMIZATION OF HYDROCARBON INJECTION DURING DIESEL PARTICULATE FILTER (DPF) REGENERATION

CROSS-REFERENCE TO RELATED APPLICATION

This application claims the benefit of U.S. Provisional Application No. 60/661,536, filed on Mar. 14, 2005. The disclosure of the above application is incorporated herein by reference.

FIELD OF THE INVENTION

The present invention relates to diesel engines, and more particularly to diesel particulate filter (DPF) regeneration.

BACKGROUND OF THE INVENTION

Diesel engines have higher efficiency than gasoline engines due to the increased compression ratio of the diesel combustion process and the higher energy density of diesel fuel. As a result, a diesel engine provides improved gas mileage than an equivalently sized gasoline engine.

The diesel combustion cycle produces particulates that are typically filtered from the exhaust gases. A diesel particulate filter (DPF) is usually disposed along the exhaust stream to filter the diesel particulates from the exhaust. Over time, however, the DPF becomes full and must be regenerated to remove the trapped diesel particulates. During regeneration, the diesel particulates are burned within the DPF to enable the DPF to continue its filtering function.

One traditional regeneration method injects diesel fuel into the cylinder after the main combustion event. The post-combustion injected fuel is expelled from the engine with the exhaust gases and is combusted over catalysts placed in the exhaust stream. The heat released during the fuel combustion on the catalysts increases the exhaust temperature, which burns the trapped soot particles in the DPF. This approach utilizes the common rail fuel injection system and does not require additional fuel injection hardware.

Typically, there is a series of criteria that must be met before regeneration is enabled. One such criteria includes the exhaust temperature achieving a threshold temperature to enable light-off of the post-injected fuel. However, the exhaust temperature achieving a threshold temperature does not accurately indicate whether a hydrocarbon fuel can be combusted within the exhaust under all operating conditions.

SUMMARY OF THE INVENTION

Accordingly, the present invention provides a diesel engine system including an exhaust system having a catalyst and a diesel particulate filter. The diesel engine system includes a first module that determines a light-off temperature of the catalyst based on an exhaust flow rate (EFR) through the exhaust system and a second module that selectively generates an enable signal based on the light-off temperature and a catalyst temperature. A DPF regeneration sequence is enabled based on said enable signal.

In another feature, the second module generates the enable signal when the catalyst temperature is greater than the light-off temperature.

In another feature, the EFR is determined based on a mass air flow (MAF) into the engine and a fueling rate of the engine.

In still another feature, the light-off temperature is determined based on a space velocity of the catalyst and the space velocity is determined based on the EFR.

In yet other features, the second module generates the enable signal based on the light-off temperature and a catalyst lower limit temperature. The second module maintains the enable signal when the catalyst temperature is less than the light-off temperature and is greater than the catalyst lower limit temperature.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
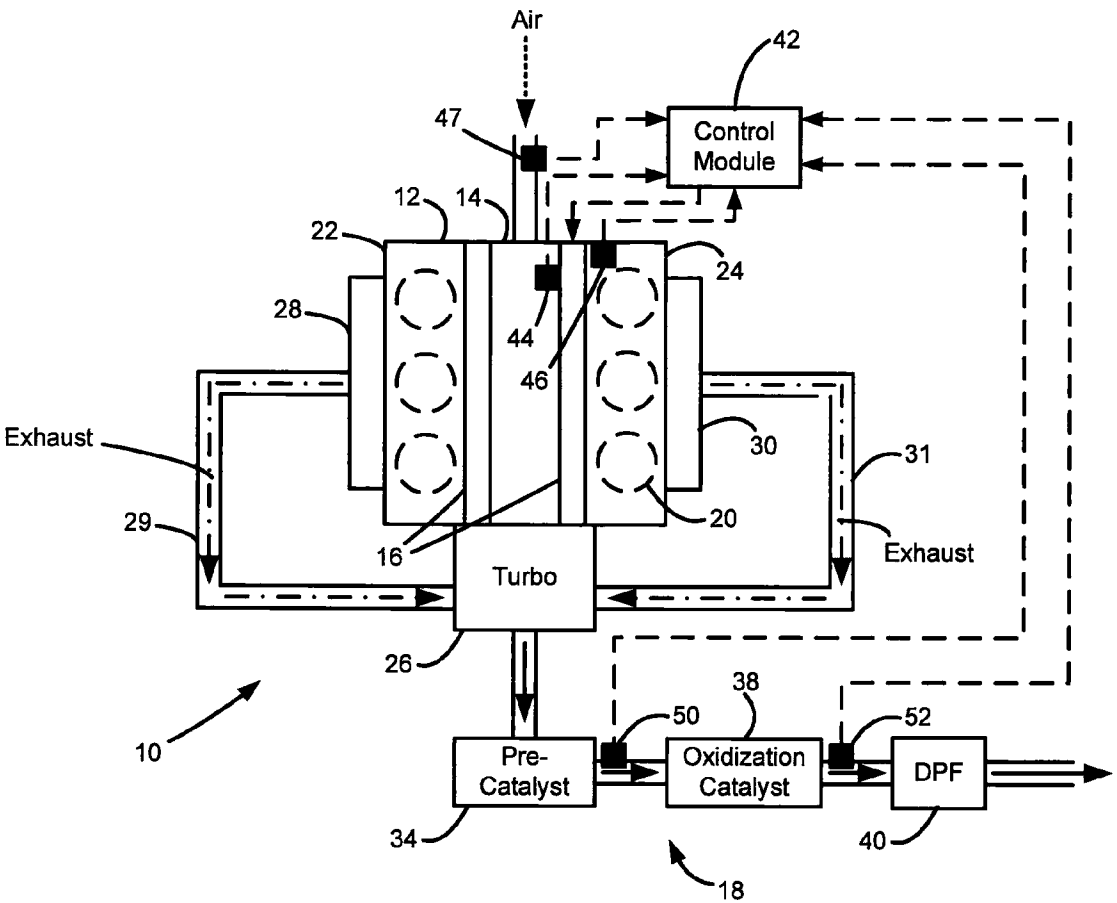
FIG. 1 is a schematic view of a diesel engine system of the present invention including an exhaust treatment system having a diesel particulate filter (DPF)

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an exemplary diesel engine system 10 is schematically illustrated. It is appreciated that the engine system 10 is merely exemplary in nature and that the DPF regeneration control of the present invention can be implemented in various engine systems. The diesel engine system 10 includes a diesel engine 12, an intake manifold 14, a common rail fuel injection system 16 and an exhaust system 18. The exemplary engine 12 includes six cylinders 20 configured in adjacent cylinder banks 22,24 in V-type layout. Although FIG. 1 depicts six cylinders (N=6), it can be appreciated that the engine 12 may include additional or fewer cylinders 20. For example, engines having 2, 4, 5, 8, 10, 12 and 16 cylinders are contemplated. It is also anticipated that the DPF regeneration control of the present invention can be implemented in an inline-type cylinder configuration, as discussed in further detail below.

Air is drawn into the intake manifold 14 through a throttle (not shown). Air is drawn into the cylinders 20 from the intake manifold 14 and is compressed therein. Fuel is injected into cylinder 20 by the common rail injection system 16 and the heat of the compressed air ignites the air/fuel mixture. The exhaust gases are exhausted from the cylinders 20 and into the exhaust system 18. In some instances, the diesel engine system 10 can include a turbo 26 that pumps additional air into the cylinders 20 for combustion with the fuel and air drawn in from the intake manifold 14.

The exhaust system 18 includes exhaust manifolds 28,30, exhaust conduits 29,31, a pre-catalyst 34, an oxidization catalyst 38 and a diesel particulate filter (DPF) 40. First and second exhaust segments are defined by the first and second cylinder banks 22,24. The exhaust manifolds 28,30 direct the exhaust segments from the corresponding cylinder banks 22,24 into the exhaust conduits 29,31. The exhaust is directed into the turbo 26, if included, to drive the turbo 26. A combined exhaust stream flows from the turbo 26 through the pre-catalyst 34, the oxidization catalyst 38 and the DPF 40. The DPF 40 filters particulates from the combined exhaust stream as it flows to the atmosphere.

A control module 42 regulates operation of the diesel engine system 10 according to the DPF regeneration control of the present invention. More particularly, the control module 42 communicates with an intake manifold absolute pressure (MAP) sensor 44 and an engine speed sensor 46. The MAP sensor 44 generates a signal indicating the air pressure within the intake manifold 14 and the engine speed sensor 46 generates a signal indicating engine speed (RPM). A mass air flow (MAF) sensor 47 generates a signal based on MAF into the engine 12. The control module 42 also communicates with a pre-catalyst temperature sensor 50 that is responsive to a temperature of the exhaust exiting the pre-catalyst 34 ($T_{PC}$) and an oxidation catalyst temperature sensor 52 that is responsive to a temperature of the exhaust exiting the oxidation catalyst ($T_{OC}$).

The control module 42 selectively enables DPF regeneration. DPF regeneration is initiated when the DPF 40 is deemed full of particulates. The control module 42 continuously estimates the amount of emitted particulates since the last DPF regeneration based on engine operating parameters. DPF regeneration is preferably initiated during conditions where exhaust temperatures exceed the required light-off threshold without special measures. For example, DPF regeneration is preferably initiated during cruising at highway speeds. DPF regeneration, however, can be initiated at less than optimum conditions if required. The duration of DPF regeneration varies based on the amount of estimated particulates within the DPF.

The DPF regeneration control of the present invention enables DPF regeneration based on an exhaust flow rate (EFR). More particularly, light-off temperatures $T_{PCLO}$ and $T_{OCLO}$ are determined based on EFR for both the pre-catalyst 34 and the oxidization catalyst, respectively. $T_{PCLO}$ and $T_{OCLO}$ are determined based on the EFR and the geometry of the respective catalysts, as explained in further detail below. EFR is calculated by the control module 42 based on engine operating conditions including, but not limited to, mass air flow (MAF) and fueling rate. The control module 42 selectively enables DPF regeneration based on a comparison of $T_{PCLO}$ and $T_{OCLO}$ to $T_{PC}$ and $T_{OC}$, respectively. $T_{PC}$ and $T_{OC}$ are determined based on the signals generated by the sensors 50, 52, respectively.

Figure 2:
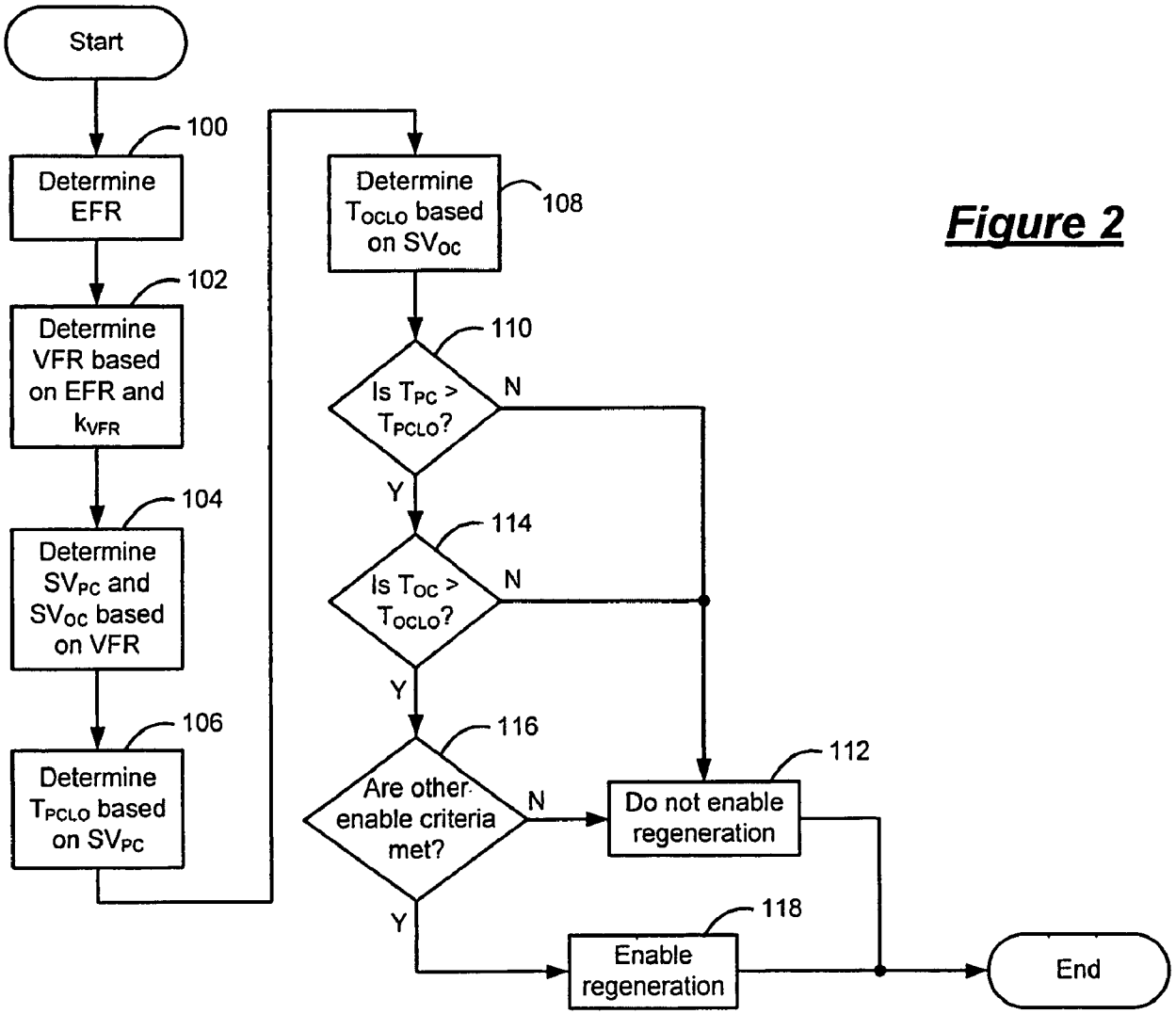
FIG. 2 is a flowchart illustrating the DPF regeneration control of the present invention.

Referring now to FIG. 2, the DPF regeneration control will be described in further detail. In step 100, control determines the EFR based on mass airflow sensor and the current calculated mass of injected fuel. In step 102, control determines a volumetric flow rate (VFR) based on the EFR and an exhaust density-based conversion factor ($k_{VFR}$). Control determines a pre-catalyst space velocity ($SV_{PC}$) and an oxidization catalyst space velocity ($SV_{OC}$) of the exhaust based on VFR and respective geometry-based conversion factors ($k_{PCSV}$, $k_{OCSV}$) in step 104.

In step 106, control determines a pre-catalyst light-off temperature ($T_{PCLO}$) based on $SV_{PC}$. It is anticipated that $T_{PCLO}$ can be determined from a look-up table based on $SV_{PC}$ or can be determined from an equation-based calculation based on $SV_{PC}$. In step 108, control determines an oxidization catalyst light-off temperature ($T_{OCLO}$) based on $SV_{OC}$. It is anticipated that $T_{OCLO}$ can be determined from a look-up table based on $SV_{OC}$ or can be determined from an equation-based calculation based on $SV_{OC}$.

In step 110, control determines whether $T_{PC}$ is greater than $T_{PCLO}$. If $T_{PC}$ is not greater than $T_{PCLO}$, the pre-catalyst temperature is insufficient to enable light-off of the hydrocarbon and control continues in step 112. If $T_{PC}$ is greater than $T_{PCLO}$, the pre-catalyst temperature is sufficient to enable light-off of the hydrocarbon and control determines whether $T_{OC}$ is greater than $T_{OCLO}$ in step 114. If $T_{OC}$ is not greater than $T_{OCLO}$, the oxidization catalyst temperature is insufficient to enable light-off of the hydrocarbon and control continues in step 114. If $T_{OC}$ is greater than $T_{OCLO}$, the oxidization catalyst temperature is sufficient to enable light-off of the hydrocarbon and control continues in step 116.

In step 116, control determines whether other regeneration enable criteria are met (e.g., calculated DPF loading exceeds the level where regeneration is required, engine at normal operation temperature and engine and exhaust sensors free of diagnostic faults). If the other regeneration enable criteria are not met, control does not enable regeneration (i.e., post-injection of hydrocarbon) and control ends. If the other regeneration enable criteria are met, control enables regeneration in step 118 and control ends.

Figure 3:
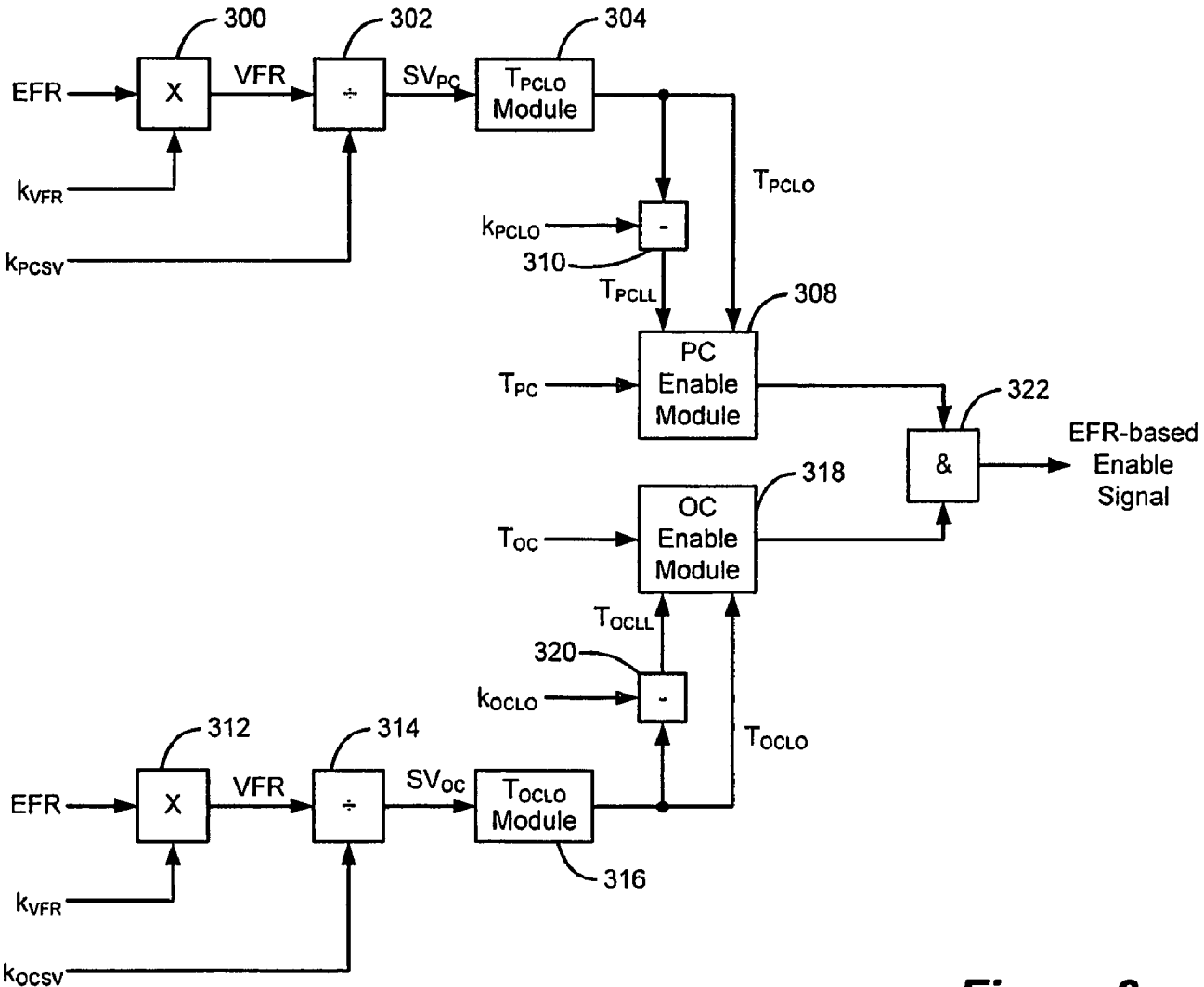
FIG. 3 is a signal flow diagram illustrating exemplary modules that execute the DPF regeneration control of the present invention.

Referring now to FIG. 3, a signal flow diagram illustrates exemplary modules that execute the DPF regeneration control of the present invention. A first function module 300 determines a volumetric flow rate (VFR) of the exhaust based on EFR and a exhaust density-based conversion factor ($k_{VFR}$). A second function module 302 determines a pre-catalyst space velocity ($SV_{PC}$) of the exhaust based on VFR and a geometry-based conversion factor ($k_{PCSV}$). More specifically, $k_{PCSV}$ is a constant that is based on the volume of the pre-catalyst 34. The pre-catalyst light-off temperature ($T_{PCLO}$) is determined by a $T_{PCLO}$ module 306 based on $SV_{PC}$. More specifically, the $T_{PCLO}$ module 306 includes a pre-calibrated curve or look-up table that correlates $SV_{PC}$ to $T_{PCLO}$.

$T_{PCLO}$ is output to a pre-catalyst (PC) enable module 308 and a function module 310. The function module 310 determines a pre-catalyst temperature lower limit ($T_{PCLL}$) based on $T_{PCLO}$ and a constant $k_{PCLO}$. More specifically, $T_{PCLL}$ is determined as the difference between $T_{PCLO}$ and $k_{PCLO}$. For example, if $T_{PCLO}$ is equal to 200° C. and $k_{PCLO}$ is equal to 20° C., $T_{PCLL}$ would be equal to 180° C. $T_{PCLL}$ is input into the PC enable module 308. The PC enable module 308 generates a PC enable signal (e.g., LO or 0=no enable and HI or 1=enable) based on $T_{PC}$, $T_{PCLL}$ and $T_{PCLO}$. More specifically, $T_{PCLO}$ and $T_{PCLL}$ define a range for enabling and disabling regeneration. For example, if $T_{PC}$ is greater than $T_{PCLO}$, the PC enable signal is HI. If $T_{PC}$ subsequently falls below $T_{PCLO}$, but is still greater than $T_{PCLL}$, the PC enable signal remains HI. The PC enable signal only subsequently goes LO when $T_{PC}$ falls below $T_{PCLL}$. In this manner, the PC enable signal is inhibited from rapidly switching between HI and LO if $T_{PC}$ floats above and below $T_{PCLO}$.

A third function module 312 determines VFR of the exhaust based on EFR and $k_{VFR}$. Although a third function module 312 is illustrated, it is appreciated that the output of the first function 300 module described above can be used. A fourth function module 314 determines an oxidization catalyst space velocity ($SV_{OC}$) of the exhaust based on VFR and a geometry-based conversion factor ($k_{OCSV}$). More specifically, $k_{OCSV}$ is a constant that is based on the volume of the oxidization catalyst 38. The oxidization catalyst light-off temperature ($T_{OCLO}$) is determined by a $T_{OCLO}$ module 316 based on $SV_{OC}$. More specifically, the $T_{OCLO}$ module 316 includes a pre-calibrated curve or look-up table that correlates $SV_{OC}$ to $T_{OCLO}$.

$T_{OCLO}$ is output to a oxidization catalyst (OC) enable module 318 and a function module 320. The function module 320 determines an oxidization catalyst temperature lower limit ($T_{OCLL}$) based on $T_{OCLO}$ and a constant $k_{OCLO}$. More specifically, $T_{OCLL}$ is determined as the difference between $T_{OCLO}$ and $k_{OCLO}$. For example, if $T_{OCLO}$ is equal to 200° C. and $k_{OCLO}$ is equal to 20° C., $T_{OCLL}$ would be equal to 180° C. $T_{OCLL}$ is input into the OC enable module 318. The OC enable module 318 generates an OC enable signal (e.g., LO or 0=no enable and HI or 1=enable) based on $T_{OC}$, $T_{OCLL}$ and $T_{OCLO}$. More specifically, $T_{OCLO}$ and $T_{OCLL}$ define a range for enabling and disabling regeneration. For example, if $T_{OC}$ is greater than $T_{OCLO}$, the OC enable signal is HI. If $T_{OC}$ subsequently falls below $T_{OCLO}$, but is still greater than $T_{OCLL}$, the OC enable signal remains HI. The OC enable signal only subsequently goes LO when $T_{OC}$ falls below $T_{OCLL}$. In this manner, the OC enable signal is inhibited from rapidly switching between HI and LO if $T_{OC}$ floats above and below $T_{OCLO}$.

The PC enable signal and the OC enable signal are output to an AND gate 322. The AND gate 322 outputs an EFR-based enable signal (e.g., LO or 0=no enable and HI or 1=enable) based on the PC enable signal and the OC enable signal. More specifically, if both the PC enable signal and the OC enable signal are HI (i.e., equal to 1) the EFR-based enable signal is HI. If either or both the PC enable signal and the OC enable signal are LO (i.e., equal to 0) the EFR-based enable signal is LO. The EFR-based enable signal is output to a regeneration enable module that selectively enables DPF regeneration based on the EFR-based enable signal and other regeneration enable criteria.

Although DPF regeneration control of the present invention is described above with respect to multiple catalysts in the exhaust system 18, it is anticipated that the DPF regeneration control can be modified in accordance with the principles of the present invention for use with other exhaust system configurations. For example, in the case of a single catalyst, a single catalyst enable signal is generated based on the EFR and the catalyst temperature.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A diesel engine system including an exhaust system having a catalyst and a diesel particulate filter, comprising:

a first module that determines a light-off temperature of said catalyst based on an exhaust flow rate (EFR) through said exhaust system; and a second module that selectively generates an enable signal based on said light-off temperature and a catalyst temperature;

wherein a DPF regeneration sequence is enabled based on said enable signal, and wherein said second module generates said enable signal based on said light-off temperature and a catalyst lower limit temperature.

2. The diesel engine system of claim 1 wherein said second module generates said enable signal when said catalyst temperature is greater than said light-off temperature.

3. The diesel engine system of claim 1 wherein said EFR is determined based on a mass air flow (MAF) into said engine and a fueling rate of said engine.

4. The diesel engine system of claim 1 wherein said light-off temperature is determined based on a space velocity of said catalyst and said space velocity is determined based on said EFR.

5. The diesel engine system of claim 1 wherein said second module maintains said enable signal when said catalyst temperature is less than said light-off temperature and greater than said catalyst lower limit temperature.

6. A method of enabling a diesel particulate filter (DPF) regeneration sequence in a diesel engine system including an exhaust system having a catalyst and a DPF, comprising:

determining a light-off temperature of said catalyst based on an exhaust flow rate (EFR) through said exhaust system; and generating an enable signal based on said light-off temperature and a catalyst temperature; and enabling said DPF regeneration sequence based on said enable signal, wherein said enable signal is generated based on said light-off temperature and a catalyst lower limit temperature.

7. The method of claim 6 wherein said enable signal is generated when said catalyst temperature is greater than said light-off temperature.

8. The method of claim 6 wherein said EFR is determined based on a mass air flow (MAF) into said engine and a fueling rate of said engine.

9. The method of claim 6 wherein said light-off temperature is determined based on a space velocity of said catalyst and said space velocity is determined based on said EFR.

10. The method of claim 6 wherein said enable signal is maintained when said catalyst temperature is less than said light-off temperature and greater than said catalyst lower limit temperature.

11. A method of enabling a diesel particulate filter (DPF) regeneration sequence in a diesel engine system including an exhaust system having a pre-catalyst, an oxidation catalyst and a DPF, comprising:

determining a pre-catalyst light-off temperature of said pre-catalyst based on an exhaust flow rate (EFR) through said exhaust system;

determining an oxidation catalyst light-off temperature of said oxidation catalyst based on said EFR through said exhaust system; and generating an enable signal based on said pre-catalyst light-off temperature, said oxidation catalyst light-off temperature, a pre-catalyst temperature of said pre-catalyst, and an oxidation catalyst temperature of said oxidation catalyst; and enabling said DPF regeneration sequence based on said enable signal, wherein said enable signal is generated based on said pre-catalyst light-off temperature, a pre-catalyst lower limit temperature, said oxidation catalyst light-off temperature, and an oxidation catalyst lower limit temperature.

12. The method of claim 11 wherein said enable signal is generated when said pre-catalyst temperature is greater than said pre-catalyst light-off temperature and said oxidation catalyst temperature is greater than said oxidation catalyst light-off temperature.

13. The method of claim 11 wherein said EFR is determined based on a mass air flow (MAF) into said engine and a fueling rate of said engine.

14. The method of claim 11 wherein said pre-catalyst light-off temperature is determined based on a space velocity of said pre-catalyst and said space velocity is determined based on said EFR.

15. The method of claim 11 wherein said oxidation catalyst light-off temperature is determined based on a space velocity of said oxidation catalyst and said space velocity is determined based on said EFR.

16. The method of claim 11 wherein said enable signal is maintained when said pre-catalyst temperature is less than said pre-catalyst light-off temperature and greater than said pre-catalyst lower limit temperature and said oxidation catalyst temperature is less than said oxidation catalyst light-off temperature and is greater than said oxidation catalyst lower limit temperature.

* * * * *